US006378398B2

(12) United States Patent
Brix-Hansen

(10) Patent No.: US 6,378,398 B2
(45) **Date of Patent: *Apr. 30, 2002**

(54) TOOL FOR BREAKING A VACUUM IN A PRESERVING JAR CLOSED WITH A SCREW CAP

(76) Inventor: Helge Brix-Hansen, Hjortsøgaardvej 6, DK-4771 Kalvehave (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/889,328

(22) Filed: Jul. 8, 1997

Related U.S. Application Data

(63) Continuation of application No. 08/684,621, filed on Jul. 22, 1996, now abandoned, which is a continuation of application No. 08/302,484, filed on Sep. 12, 1994, now abandoned, which is a continuation-in-part of application No. PCT/DK93/00089, filed on Mar. 10, 1993.

(51) Int. Cl.[7] ..... B67B 7/16
(52) U.S. Cl. ..... 81/3.57; 81/3.55
(58) Field of Search ..... 81/3.55–3.57

(56) References Cited

U.S. PATENT DOCUMENTS

| | | | | |
|---|---|---|---|---|
| 55,878 | A | 6/1866 | Livermore | 81/3.57 |
| 1,724,722 | A | 8/1929 | Plack | 81/3.56 |
| 2,542,329 | A | 2/1951 | Hammond, Jr. | 81/3.57 |
| 2,836,998 | A | 6/1958 | White | 81/3.56 |
| 4,858,502 | A | 8/1989 | Warburg | 81/3.57 |

*Primary Examiner*—James G. Smith
(74) *Attorney, Agent, or Firm*—Antonelli, Terry, Stout & Kraus, LLP

(57) ABSTRACT

A tool for breaking a vacuum in a preserving jar closed with a circular lid. The tool is provided with an oblong handle (1), which at one end has a portion (5) for engaging the cap (7) of a preserving jar (8), and a jaw (2) for engaging the lower edge of the cap. The mouth of the jaw is turned away from the other end of the handle, and between the free end (3) of the jaw and the portion (5) for engaging the cap (7) a concave, circular cylindrical guide slot (6) is provided for guiding the tool into position against the rim of the cap in such a way that the jaw grips the lower edge of the cap, after which a slight lifting of the handle brings about an elastic deformation of the rim of the cap allowing the vacuum in the preserving jar to be broken.

8 Claims, 2 Drawing Sheets

TOOL FOR BREAKING A VACUUM IN A PRESERVING JAR CLOSED WITH A SCREW CAP

This application is a continuation of application Ser. No. 08/684,621, filed Jul. 22, 1996 now abandoned which is a continuation of application Ser. No. 08/302,484 filed Sep. 12, 1994 and now abandoned which is a continuation-in-part of International Application No. PCT/DK93/00089 filed Mar. 10, 1993 which designates the United States of America.

BACKGROUND OF THE INVENTION

The present invention relates to a tool for breaking a vacuum in a preserving jar closed with a screw cap, said tool comprising an oblong handle, which at one end has a portion for engaging the periphery of the cap, and a jaw for engaging the lower edge of the cap.

A tool of this kind is known from DE patent application No. 38 22 745. In this tool the portion for engaging the cap comprises two essentially perpendicular arms tapering towards the ends, and the edges which are intended to engage the cap form a small angle with each other in such a way that each arm only contacts the rounded outer rim of the cap at a single point.

When the tool is used, the jaw is advanced towards the cap, the free end of the jaw reaching under the edge of the cap while the portion with the two arms abuts the rim of the cap, the handle extending diametrically across the cap. The handle is then pressed down against the cap to pivot about a line through the two contact points between said arms and the cap, whereby the jaw is intended to engage the edge of the cap and deform it elastically and thus break the vacuum in the jar.

The tool suffers, however, from the major drawback that the handle, in particular when used for breaking a vacuum in a jar with a comparatively big diameter, will abut the upper rim of the cap at a point diametrically opposite the jaw, before the jaw has lifted the edge of the cap sufficiently, which results in the vacuum not being broken. On account of the shapes-of the two arms the tool tends to slide away from the cap during the pivoting movement, which further amplifies the above-mentioned drawback.

The tool also suffers from the disadvantage that it is difficult to simultaneously hold the tool and to present it to the cap as the fingers cannot grasp the handle, as the fingers would then be squeezed between the handle and the cap when the handle is pressed against the cap.

SUMMARY OF THE INVENTION

The object of the invention is to provide a tool of the type mentioned by way of introduction, which does not have the above-mentioned drawbacks and which is designed in such a way that the user intuitively understands how to use it.

This object is met according to the invention by a tool which has as characteristics in that the portion for engaging the cap is adapted to bear on the upper surface of the cap, that the mouth of the jaw is turned away from the other end of the handle, that the free end of the jaw forms a concave arc of a circle, and that between the handle and the jaw is a guide means in the shape of a slot forming a concave, cirular arc. In this embodiment the fingers may grasp. the handle of the tool, and the end of the tool with the jaw may in a natural way be advanced towards the rim of the cap, where it is guided to the rim by the concave, circular, cylindrical guide slot, the radius of which is of the same order as the radius of commonly used caps. The circular arc formed by the free edge of the jaw likewise has a radius corresponding to the radius of the neck of the commonly used jars. This makes it possible for the jaw to reach all the way to the jar over its whole width, and it is thereby ensured that the jaw safely rests on the lower side of the rim of the cap and not simply contacts the rim at a single point. The handle is then lifted, slightly thereby pivoting about the line of Contact between the upper side of the cap and the portion bearing on the cap. By this movement the jaw grips the lower edge of the cap and gives it an elastic deformation sufficient for breaking the vacuum in the jar. As the tool according to the invention bears on the upper side of the cap and not like the known tool the rounded outer rim of the cap, it does not, when used, like the known tool, tend to slide away from the cap.

In a preferred embodiment the portion for engaging the cap may be a plane surface in the shape of a circular segment. By this embodiment a line contact is established during the pivoting of the tool between the edge of the plane surface constituting the chord of the circle segment and the upper side of the rim of the cap, which is usually a plane, annular surface. Such a line contact is more gentle on the cap than the point contact occurring in case of the known tool when used.

In another embodiment the circular segment may have such a size that when the tool is used it spans over two thread sections in the screw cap. The thread on the commonly used jars is a quadruple thread in case of small jars and a sextuple thread in cane of big jars. As the pitch of the thread is comparatively big, and the portion of the neck of the jar provided with threads comaparatively short, each thread or thread portion only extends over a comparatively small part of the circumference of the neck. The cap does not have an actual thread, but the rim of the cap facing downwards is flanged with a view to reinforcing the rim, except for four or six sections positioned equally spaced along the circumference, where the edge forms a flap facing the centre of the cap. When screwing on the cap these flaps engage the threads of the jar and therefore act as a kind of interior threads.

Tests have shown that it Is advantageous that the circular segment span over two thread sections in the cap in order to obtain a suitable elastic deformation of the rim of the cap for breaking the vacuum in the jar if the circular segment spans over more thread sections, the pivoting line will, when the tool is used, be closer to the centre of the cap, and the lever between the pivoting line and the jaw will therefore become so long, that a user applies too large a force to break the vacuum and counteracts this by steadying the jar with the other hand, whereby the rim becomes permanently deformed. If, however, the circular segment spans over a smaller area, for instance only a single thread section, the force applied by the user to the rim of the cap will be concentrated on a small area, and there in a risk that a permanent deformation of the rim of the cap will occur.

In a further embodiment the length of the jaw may be adjustable. Even though most jars on the market are provided with caps of standard size, caps having an extra high rim may also be found on the market. In said embodiment the tool may also be used for such jars, in addition to being used for the more common jars.

BRIEF DESCRIPTION OF THE DRAWINGS

The invention will now be explained in detail by means of preferred embodiments and with reference to the drawing, in which.

BRIEF DESCRIPTION OF PREFERRED EMBODIMENTS

Figure 2:
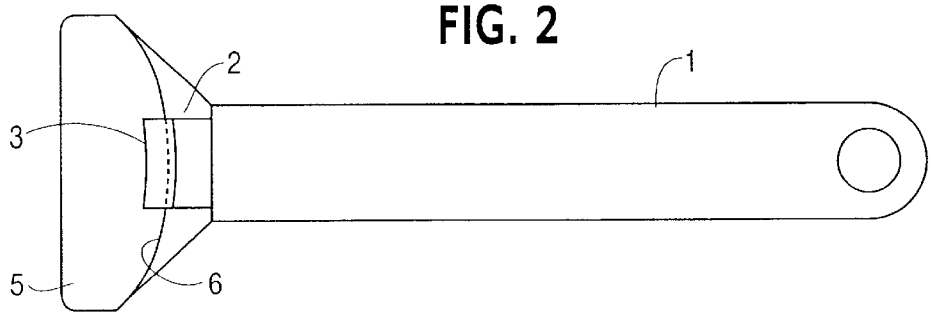
FIG. 2 is a plane view of the tool seen from below.

The tool shown in the drawing has an oblong handle 1 and a jaw 2, the free end 3 of which is formed in a concave circular arc. As beat seen from FIG. 4 the underside of the jaw is bevelled, which permits it to be free of the annular bead 4 normally present on preserving jars 8. Above the jaw 2 the tool has a plans surf ace 5, which essentially has the shape of a circular segment, the circular boundary being formed by a circular guide slot 6 positioned in the jaw 2 between its free end 3 and the surface 5. The radius of the guide slot 6 and the jaw 2 corresponds to the radius of the biggest caps 7 and the radius of the neck of the corresponding jars 8, respectively, for which the tool is intended to be used. The pressure surface 5 spans over the area between two thread sections 9 in the cap 7.

Figure 1:
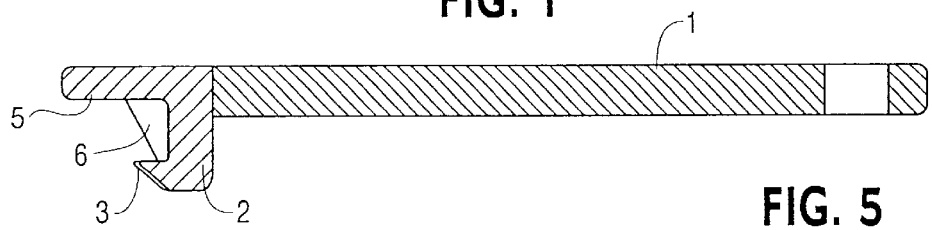
FIG. 1 is a lateral sectional view of a tool according to the invention.
Figure 4:
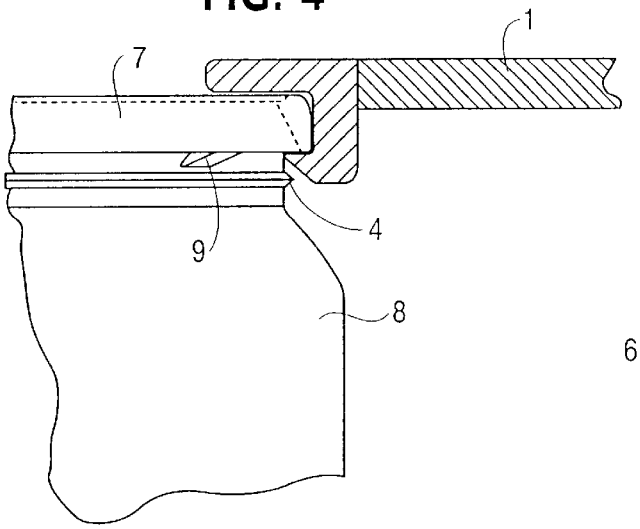
FIG. 4 is a sectional view showing the tool in engagement with the cap of a jar.
Figure 3:
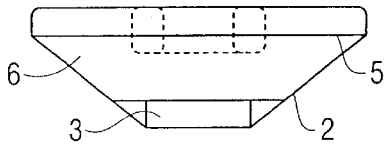
FIG. 3 is an end view of the tool.

As indicated by means of the hatchings in FIGS. 1 and 4, the tool may, in a not further specified way, consist of a head with a jaw, pressure surface 5 and guide 6, and a separate handle 1.

Figure 5:
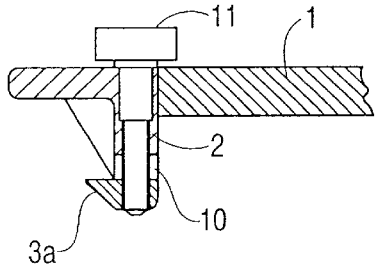
FIG. 5 is a tool with an adjustable jaw.

In the embodiment shown in FIG. 5 the free end of the jaw 2 is a separate part 3*a*, which is displaceable in a slot 10 in the jaw 2. The part 3*a* is secured in the slot 10 by a threaded bolt 11, and the length of the jaw may be adjusted by turning the bolt 11.

As mentioned, it is important that the said pivoting line be located at a rather critical distance from the outer edge of the engaged area of the lid. In practice the vast majority of standard lids have an exterior diameter of 82–85 mm and a top ridge located slightly inside the periphery, as also indicated in FIG. 4. The exterior diameter of the ridge is some 77 mm, and the width thereof is about 2 mm. Thus, the pivoting line will be defined by the engagement of the opposed, foremost and outermost portions of the top plane 5 against the ridge, and it has been found that the tool operates ideally when the length of this line, measured as a chord to the ridge, is some 40–45 mm, i.e. corresponding to the radius of the lid or one sixth of the periphery of the lid. Also, as mentioned, when the glass mounting has six thread sections the said pivot line should span over two such sections, from middle to middle therof.

These measure relations are reproduced in the authentic illustration in FIG. 1, where the curvature of the abutment face 6 represents the peripheral curvature of the lid to which the tool is adapted. The length of the pivot line should be between one fifth and one seventh of the periphery of the lid, preferable close to one sixth.

Figure 6:
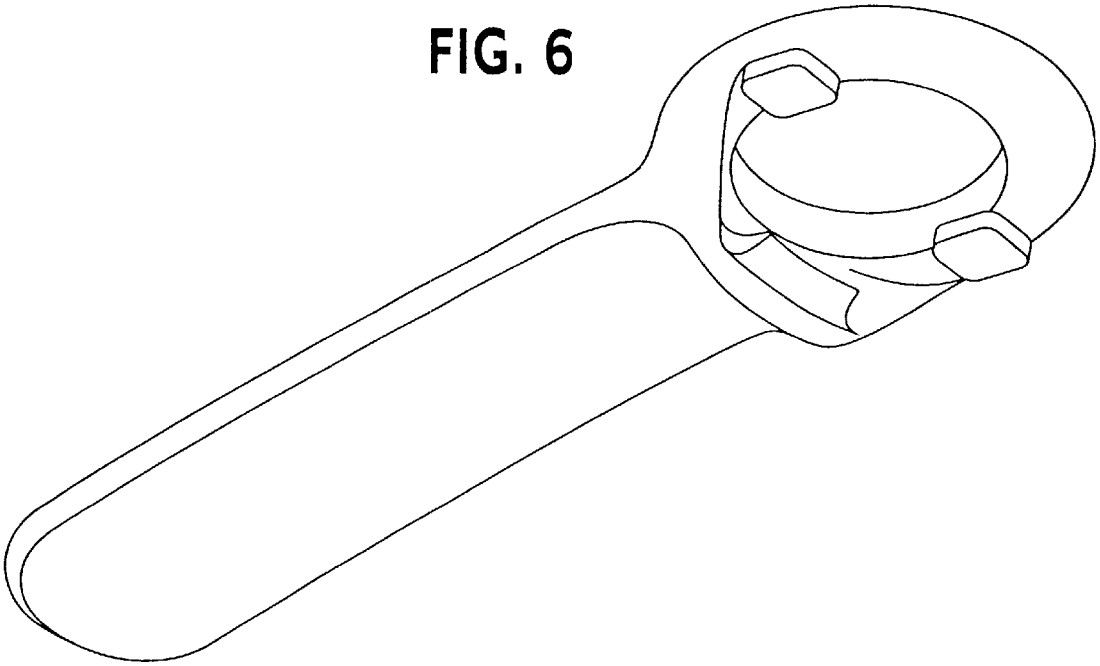
FIG. 6 is a perspective view showing another embodiment of the tool according to the invention.

In FIG. 6 is shown a modified embodiment of the tool, where the top portion 20 is designed as a ring structure, based on the fact that the middle part of the portion 5 in FIG. 1 will not at all touch the lid, located as it is in the space inside the said edge ridge of the lid. In the embodiment of FIG. 6, what is left to touch the top side of the lid is two opposed bosses 21 located so as to engage the ridge of the lid, preferably with a center spacing of 38–42 mm and a width of 5–10 mm. Ideal measures, in accordance with the above considerations, are a center spacing of 40 mm and a width, when circularly shaped, of 7 mm, for cooperation with the most widely used standard lids.

What is claimed is:

1. A tool for breaking a vacuum in a vertically-positioned jar closed by a circular lid having a rim with a lower edge and having a planar upper surface with an upwardly-extending ridge adjacent the rim, said tool comprising:

an elongated handle having a longitudinal axis about which said handle is symmetrical and having a substantially planar upper surface;

a jaw portion formed at a first end of said handle and including a guide portion in the form of a concave, part-cylindrical wall having an upper end and a lower end and extending generally transversely of a direction parallel to the longitudinal axis of the elongated handle so as to face away from the handle, with a free end projecting from a central portion of the jaw portion lower end in a direction and plane substantially parallel with the longitudinal axis of and plane defined by the upper surface of said elongated handle;

a tool head including a top portion extending from a central portion of the upper end of said jaw portion guide portion in a direction and plane substantially parallel with the longitudinal axis of and plane defined by the upper surface of said elongated handle and to a distance greater than the distance to which said jaw portion free end projects, said top portion extending wider than said jaw portion, wherein the distance between the jaw portion free end and the tool head top portion permits the tool head to be laterally inserted over the jar lid so that the jaw portion concave guide portion wall engages a location on the rim of the lid, the jaw portion free end engages under the lower edge of the lid side surface, and the top portion overlies a portion of the upper surface of the lid and is positioned adjacent the lid ridge when the handle is horizontal, whereby, when the handle is pivoted upwardly, the tool head top portion is pressed against the lid ridge at a chord of the lid spaced inside the lid rim location engaged by said guide portion wall so as to enable lifting of the lid side surface sufficiently to resiliently deform the lid and break the vacuum in the jar.

2. A tool according to claim 1, in which said tool head top portion has the shape of a partial circle which extends to an edge overlying the chord of the circular lid.

3. A tool according to claim 1, in which said tool head top portion has an annular shape and includes a pair of bosses extending downwardly from said annular body.

4. A tool according to claim 1, in which said guide portion includes adjustable connecting means connecting said jaw portion free end to said tool head, while permitting adjustment of the distance between said jaw portion free end and said tool head portion.

5. A tool for breaking a vacuum in a vertically-positioned jar closed by a circular lid having a rim with a lower edge and having a planar upper surface, said tool comprising:

an elongated handle having a longitudinal axis about which said handle is symmetrical and having a substantially planar upper surface;

a jaw portion formed at a first end of said handle and including a guide portion in the form of a concave, part-cylindrical wall having an upper end and a lower end and extending generally transversely of a direction parallel to the longitudinal axis of the elongated handle so as to face away from the handle, with a free end projecting from a central portion of the jaw portion lower end in a direction and plane substantially parallel with the longitudinal axis of and plane defined by the upper surface of said elongated handle;

a tool head including a top portion extending from a central portion of the upper end of said jaw portion guide portion in a direction and plane substantially parallel with the longitudinal axis of and plane defined by the upper surface of said elongated handle and to a distance greater than the distance to which said jaw portion free end projects, wherein the distance between the jaw portion free end and the tool head top portion permits the tool head to be laterally inserted over the jar lid so that when the handle is horizontal the jaw portion concave guide portion wall engages a location on the rim of the lid, the jaw portion free end engages under the lower edge of the lid side surface, and the top portion overlies a portion of the upper surface of the lid, whereby, when the handle is then pivoted upwardly, the tool head top portion is pressed against the lid at a chord of the lid spaced inside the lid rim location engaged by said guide portion wall so as to enable lifting of the lid side surface sufficiently to resiliently deform the lid and break the vacuum in the jar.

6. A tool according to claim 5, in which said tool head top portion has the shape of a partial circle which extends to an edge overlying the chord of the circular lid.

7. A tool according to claim 5, in which said tool head top portion has an annular shape and includes a pair of bosses extending downwardly from said annular body.

8. A tool according to claim 5, in which said guide portion includes adjustable connecting means connecting said jaw portion free end to said tool head, while permitting adjustment of the distance between said jaw portion free end and said tool head portion.

* * * * *